US009070501B2

(12) United States Patent
Sumino et al.

(10) Patent No.: US 9,070,501 B2
(45) Date of Patent: Jun. 30, 2015

(54) ELECTROMAGNET DEVICE, METHOD OF ASSEMBLING THE SAME, AND ELECTROMAGNETIC RELAY USING THE SAME

(71) Applicant: Omron Corporation, Kyoto-shi (JP)

(72) Inventors: Toshifumi Sumino, Katano (JP); Masaaki Yamamoto, Ibaraki (JP); Tatsuro Kato, Kusatsu (JP); Kazuya Murakami, Kusatsu (JP); Harumichi Kitaguchi, Moriyama (JP); Shinichi Furusho, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/954,054

(22) Filed: Jul. 30, 2013

(65) Prior Publication Data

US 2014/0055223 A1 Feb. 27, 2014

(30) Foreign Application Priority Data

Aug. 24, 2012 (JP) ..... 2012-185883

(51) Int. Cl.
*H01F 7/08* (2006.01)
*H01F 7/14* (2006.01)
(Continued)

(52) U.S. Cl.
CPC ..... *H01F 7/14* (2013.01); *Y10T 29/49071* (2015.01); *H01F 7/122* (2013.01); *H01H 50/36* (2013.01); *H01H 51/2236* (2013.01); *H01H 2050/367* (2013.01); *H01F 41/06* (2013.01); *H01F 7/081* (2013.01)

(58) Field of Classification Search
CPC ..... H01F 7/122; H01F 7/1615; H01F 7/1646; H01F 7/14; H01F 7/08; H01F 7/00; H01F 2007/1692; H01F 3/00
USPC ..... 335/229
See application file for complete search history.

(56) References Cited

U.S. PATENT DOCUMENTS 2,735,968 A * 2/1956 Bogue et al. ..... 335/275
3,569,890 A * 3/1971 Baratelli ..... 335/170
(Continued)

FOREIGN PATENT DOCUMENTS

AT 394283 B 2/1992
EP 1420428 A1 10/2003
EP 2328165 A1 6/2011

OTHER PUBLICATIONS

European Search Report for corresponding application EP13178823 dated Dec. 6, 2013.

*Primary Examiner* — Shawki S Ismail
*Assistant Examiner* — Lisa Homza
(74) *Attorney, Agent, or Firm* — Klarquist Sparkman, LLP

(57) ABSTRACT

The present invention provides an electromagnet device which can obtain a desirable attraction force (retention force) between an iron core and a movable iron piece, a method of assembling the electromagnet device and an electromagnetic relay using the electromagnet device, the electromagnet device including an electromagnet block having the iron core being wound by a coil and an auxiliary yoke fixed to one end portion of the iron core, a yoke connected to the one end portion of the iron core via a permanent magnet, the movable iron piece pivotably supported on a pivoting shaft center (serving as a fulcrum) located in an end face edge portion of the yoke so that the movable iron piece pivots on a basis of magnetization and demagnetization of the electromagnet block, where the permanent magnet is located on an extension line of an axial center of the iron core and is interposed between the auxiliary yoke and the yoke.

8 Claims, 11 Drawing Sheets

(51) Int. Cl.

| | |
|---|---|
| ***H01F 7/122*** | (2006.01) |
| ***H01H 50/36*** | (2006.01) |
| ***H01H 51/22*** | (2006.01) |
| ***H01F 41/06*** | (2006.01) |

(56) References Cited

U.S. PATENT DOCUMENTS

| | | | | | |
|---|---|---|---|---|---|
| 3,710,290 | A * | 1/1973 | Kuipers et al. | ..... | 335/230 |
| 3,747,035 | A * | 7/1973 | Morimoto et al. | ..... | 335/106 |
| 3,775,715 | A * | 11/1973 | Bosch et al. | ..... | 335/230 |
| 4,658,226 | A * | 4/1987 | Maenishi et al. | ..... | 335/127 |
| 4,672,344 | A * | 6/1987 | Schedele | ..... | 335/230 |
| 5,049,845 | A * | 9/1991 | Yokoyama et al. | ..... | 335/133 |
| 6,486,760 | B2 * | 11/2002 | Miyazaki et al. | ..... | 335/78 |
| 7,205,870 | B2 * | 4/2007 | Sanada et al. | ..... | 335/78 |
| 7,750,769 | B2 * | 7/2010 | Minowa et al. | ..... | 335/78 |
| 2010/0283563 | A1 * | 11/2010 | Minowa et al. | ..... | 335/202 |

* cited by examiner

ELECTROMAGNET DEVICE, METHOD OF ASSEMBLING THE SAME, AND ELECTROMAGNETIC RELAY USING THE SAME

CROSS-REFERENCE TO RELATED APPLICATION

This application claims benefit of priority to Japanese Patent Application No. 2012-185883, filed on Aug. 24, 2012 of which the full contents are herein incorporated by reference.

BACKGROUND OF THE INVENTION

The present invention relates to an electromagnet device.

C Japanese Utility Model Publication No. 1983-157947 discloses one of the conventional electromagnetic device to be used in an electromagnetic relay. The electromagnetic relay disclosed in the said document attracts and retains a movable iron piece and uses residual magnetism of a magnetic circuit, wherein the magnetic circuit consists of an iron core with a coil wound around, an iron core frame made of a semi-hard magnetic material, and the movable iron piece. In this electromagnetic relay, since the iron core frame is made of a semi-hard magnetic material, the iron core frame itself is magnetized to become a magnet.

However, in this electromagnetic relay, it is difficult to obtain a desirable attraction force between the iron core and the movable iron piece. Hence, for example, when a large switching load is needed, it is difficult to drive a movable touch piece having a large spring force. Particularly while maintaining a moved state, a strong retention force is needed. Accordingly, it is difficult to put this electromagnetic relay into practical use.

SUMMARY OF THE INVENTION

The present invention provides a desirable attraction force (retention force) between an iron core and a movable iron piece of an electromagnet device.

In accordance with one aspect of an electromagnet device including: an electromagnet block that includes an iron core being wound by a coil and an auxiliary yoke fixed to one end portion of the iron core; a yoke connected to the one end portion of the iron core via a permanent magnet; a movable iron piece pivotably supported on a pivoting shaft center, located in an end face edge portion of the yoke so that the movable iron piece is adapted to pivot on a basis of magnetization and demagnetization of the electromagnet block, wherein the permanent magnet is located on an extension line of an axial center of the iron core and is interposed between the auxiliary yoke and the yoke.

According to one embodiment of the electromagnet device, wherein the auxiliary yoke further comprises a caulking hole having an annular step portion on an upper surface of the caulking whole, and one end portion of the iron core is fitted into the caulking hole.

According to another embodiment of the electromagnet device, one end portion of the iron core is fitted into the caulking hole of the auxiliary yoke by spin caulking.—The term "spin caulking" means a method of pressing down the one end portion of the iron core while rotating a jig, thereby caulking the one end portion of the iron core into the caulking hole of the auxiliary yoke.

According to still another embodiment of the electromagnet device, the yoke and the auxiliary yoke are connected to each other via narrow-width portions, the narrow-width portions extends from adjacent corner portions of the auxiliary yoke.

The invention also provides a method of assembling an electromagnet device that includes an electromagnet block, the method includes winding a coil around a spool, inserting an iron core into a central hole of the spool, caulkin-fixing an auxiliary yoke to one end of the iron core which protrudes from the spool, pivotably supporting a movable iron piece through a yoke, the movable iron piece is adapted to pivot on a basis of magnetization and demagnetization of the electromagnet block, unifying the yoke and the permanent magnet by joining the yoke to the permanent magnet and connecting and fixing the auxiliary yoke and the yoke to each other so that the permanent magnet is interposed between the auxiliary yoke and the yoke.

A method of assembling an electromagnet device comprising an electromagnet block, the method further comprising winding a coil around a spool, inserting an iron core into a central hole of the spool, caulking-fixing an auxiliary yoke to one end of the iron core which protrudes from the spool, pivotably supporting a movable iron piece through a yoke, the movable iron piece is adapted to pivot on a basis of magnetization and demagnetization of the electromagnet block, unifying the permanent magnet and the auxiliary yoke by joining the permanent magnet to an outer surface of the auxiliary yoke, and connecting and fixing the auxiliary yoke and the yoke to each other so that the permanent magnet is interposed between the auxiliary yoke and the yoke.

The invention also provides a method of assembling an electromagnet device that includes an electromagnet block, the method further includes winding a coil around a spool, inserting an iron core in a central hole of the spool, and caulking-fixing an auxiliary yoke to one end of the iron core which protrudes from the spool, pivotably supporting a movable iron piece through a yoke, the movable iron piece is adapted to pivot on a basis of magnetization and demagnetization of the electromagnet block, unifying the yoke and the permanent magnet by joining the yoke to the permanent magnet, and joining opposing surfaces of the auxiliary yoke and the yoke to each other so that the permanent magnet is interposed between the auxiliary yoke and the yoke.

The invention further provides an electromagnetic relay comprising the electromagnet device as discussed above.

DETAILED DESCRIPTION

Figure 1A:
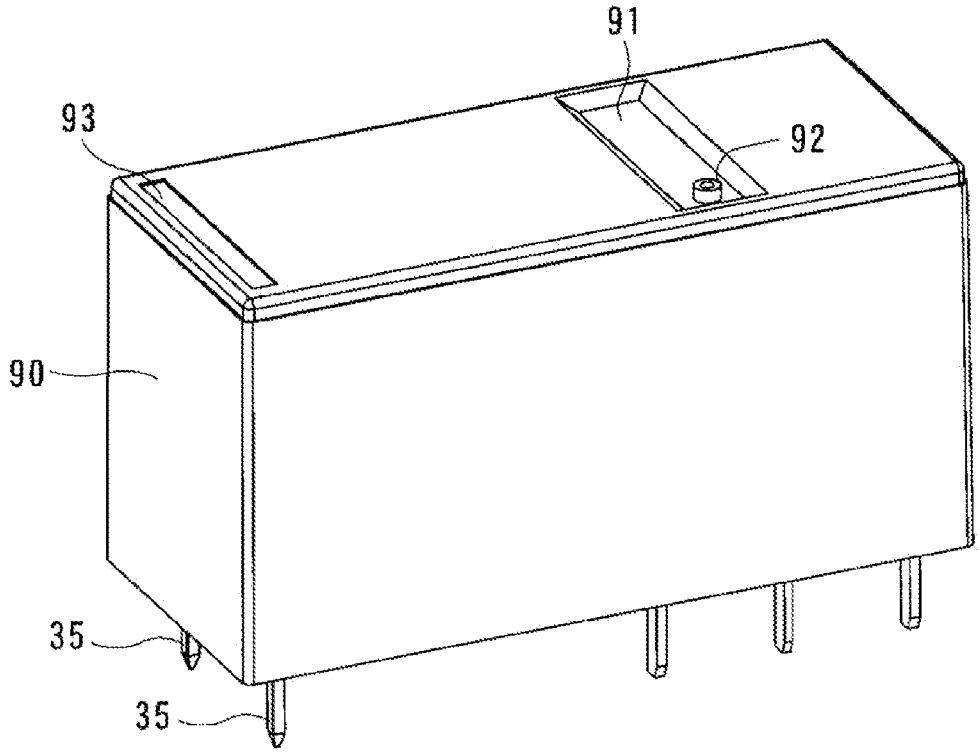
FIGS. 1A and 1B are perspective views of an electromagnetic relay incorporating an electromagnet device according to a first embodiment of the invention.
Figure 1B:
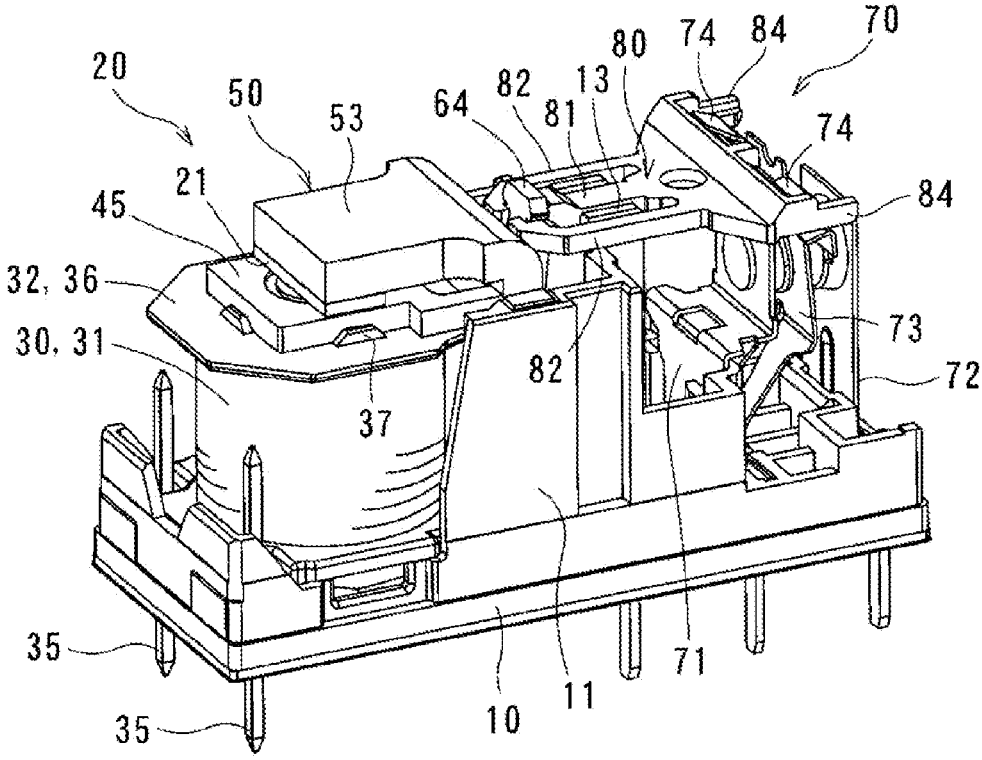

An electromagnet device according to the present invention is described with reference to the FIGS. 1A to 10B. The electromagnet device is incorporated into a latching type electromagnetic relay as illustrated in FIGS. 1A to 8B. In this case, the electromagnetic relay includes a base 10, an electromagnet device 20, a contact mechanism 70, a card 80 and a box-shaped cover 90. Further, the card 80 is connected to the electromagnet device 20 and drives the contact mechanism 70.

Figure 2:
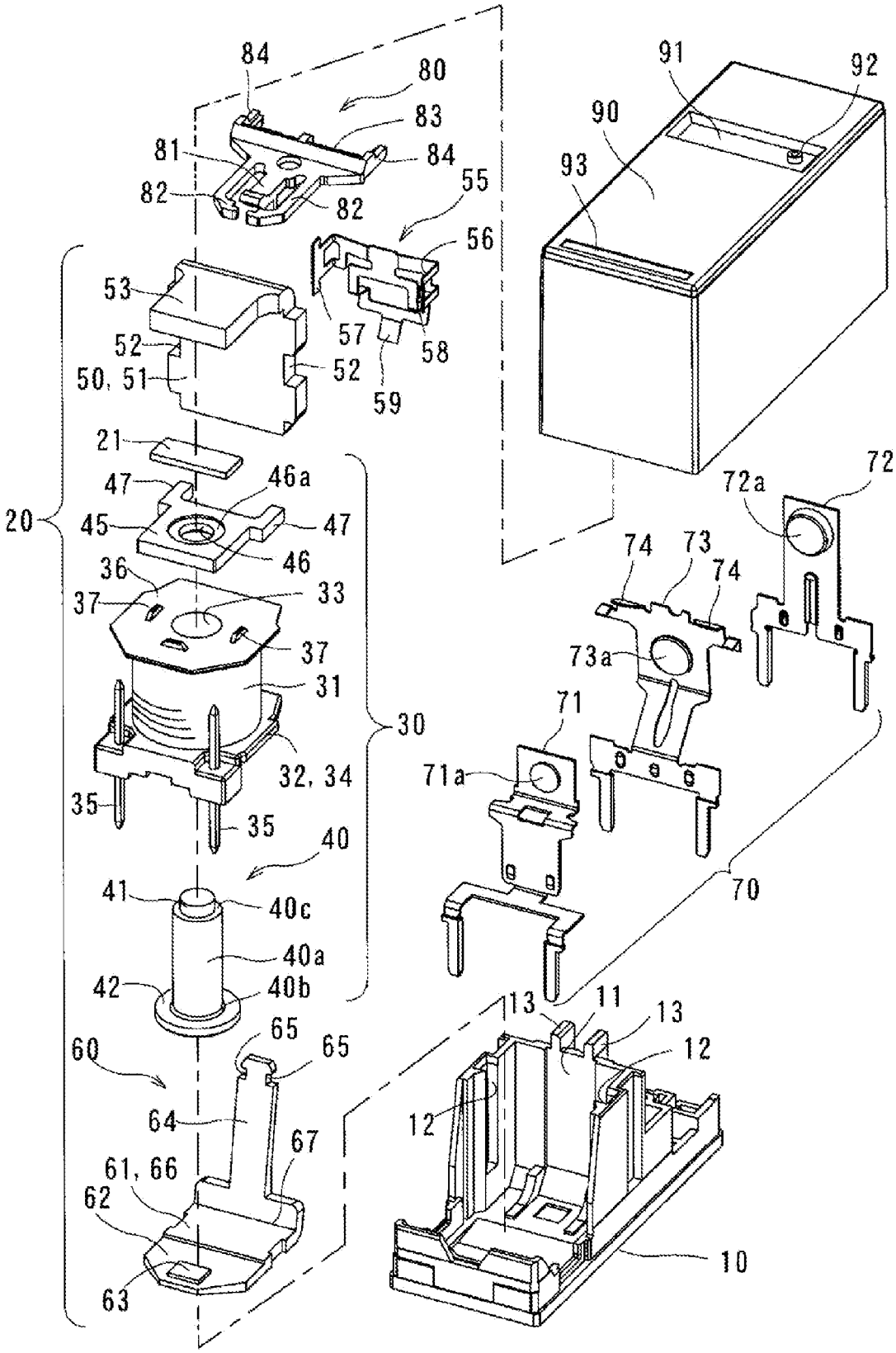
FIG. 2 is an exploded perspective view of the electromagnetic relay as illustrated in FIG. 1, which is obliquely viewed from the top.
Figure 3:
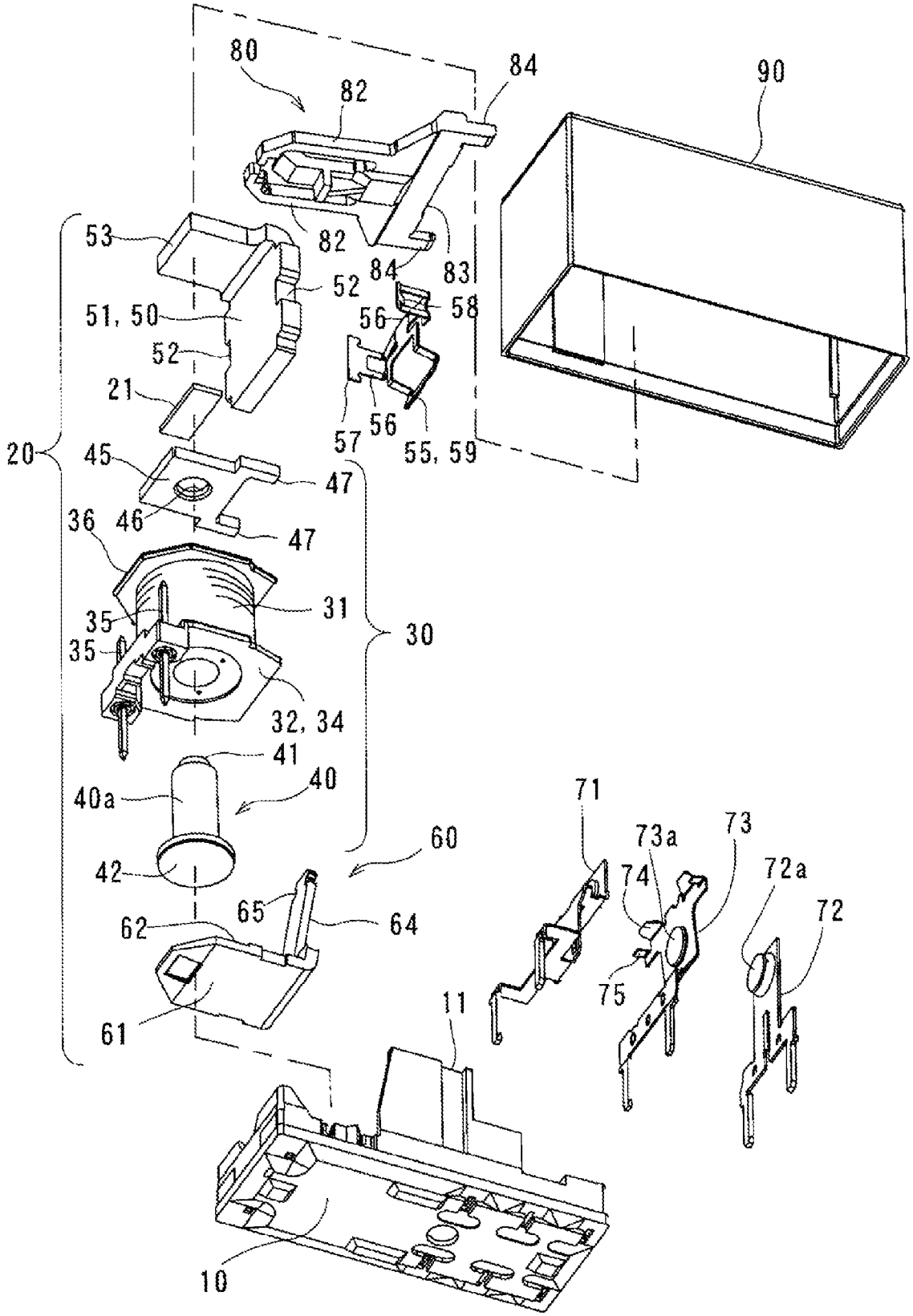
FIG. 3 is an exploded perspective view of the electromagnetic relay as illustrated in FIG. 1, which is obliquely viewed from the bottom.

As illustrated in FIGS. 2 and 3, in the base 10 has an approximately C-shaped insulation wall 11 which protrudes from an upper surface of the base 10 and is located at a center portion on the upper surface. In addition, the electromagnet device 20 described below is arranged on one side on the upper surface, and the contact mechanism 70 is arranged on the other side on the upper surface. The insulation wall 11 includes fitting grooves 12 formed in both inside surfaces, respectively which face each other. In the fitting grooves 12, both side edge portions of a yoke 50 are press-fitted. In addition, a center portion of an upper end of the insulation wall 11 is provided with a pair of guide ribs 13 that are in parallel with each other and protrude from an upper surface thereof.

Figure 4A:
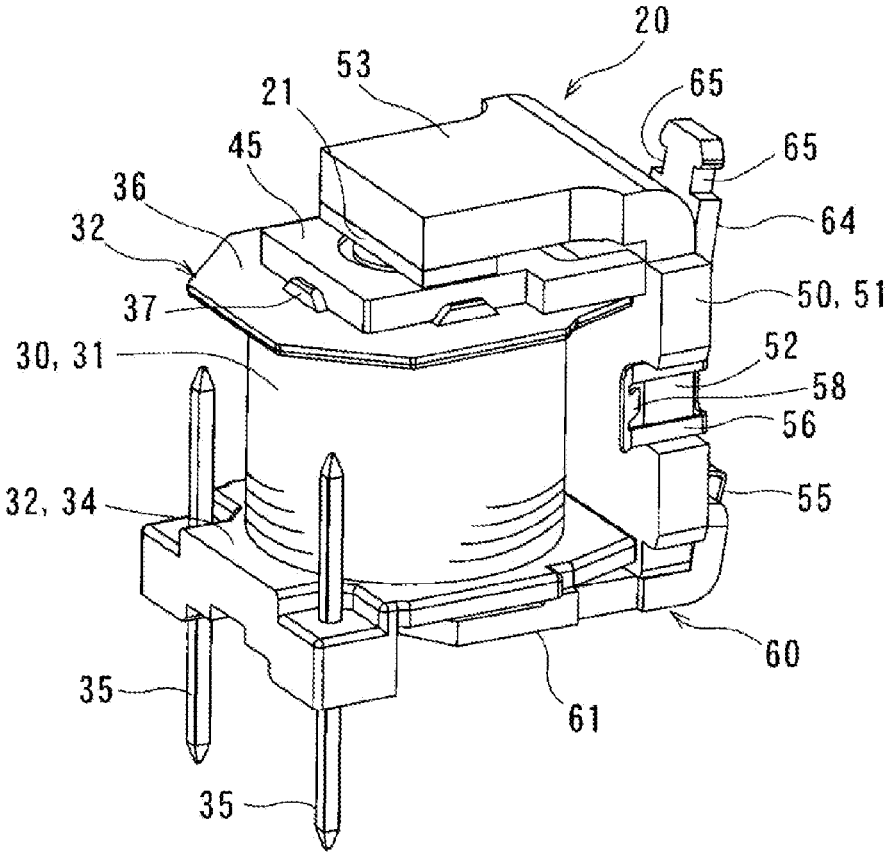
FIGS. 4A and 4B are perspective views showing the electromagnet device.
Figure 4B:
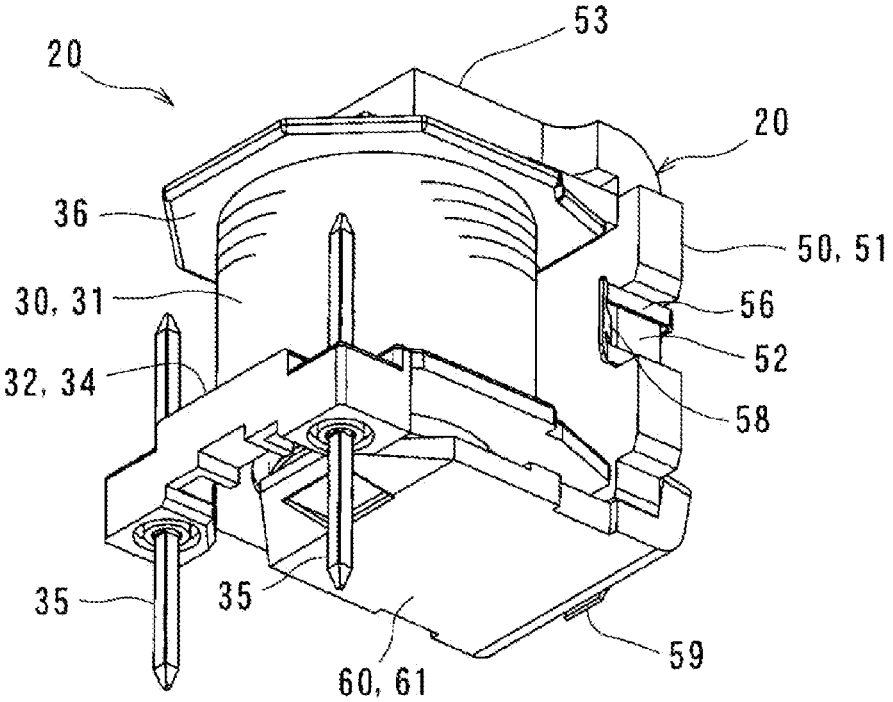
Figure 5:
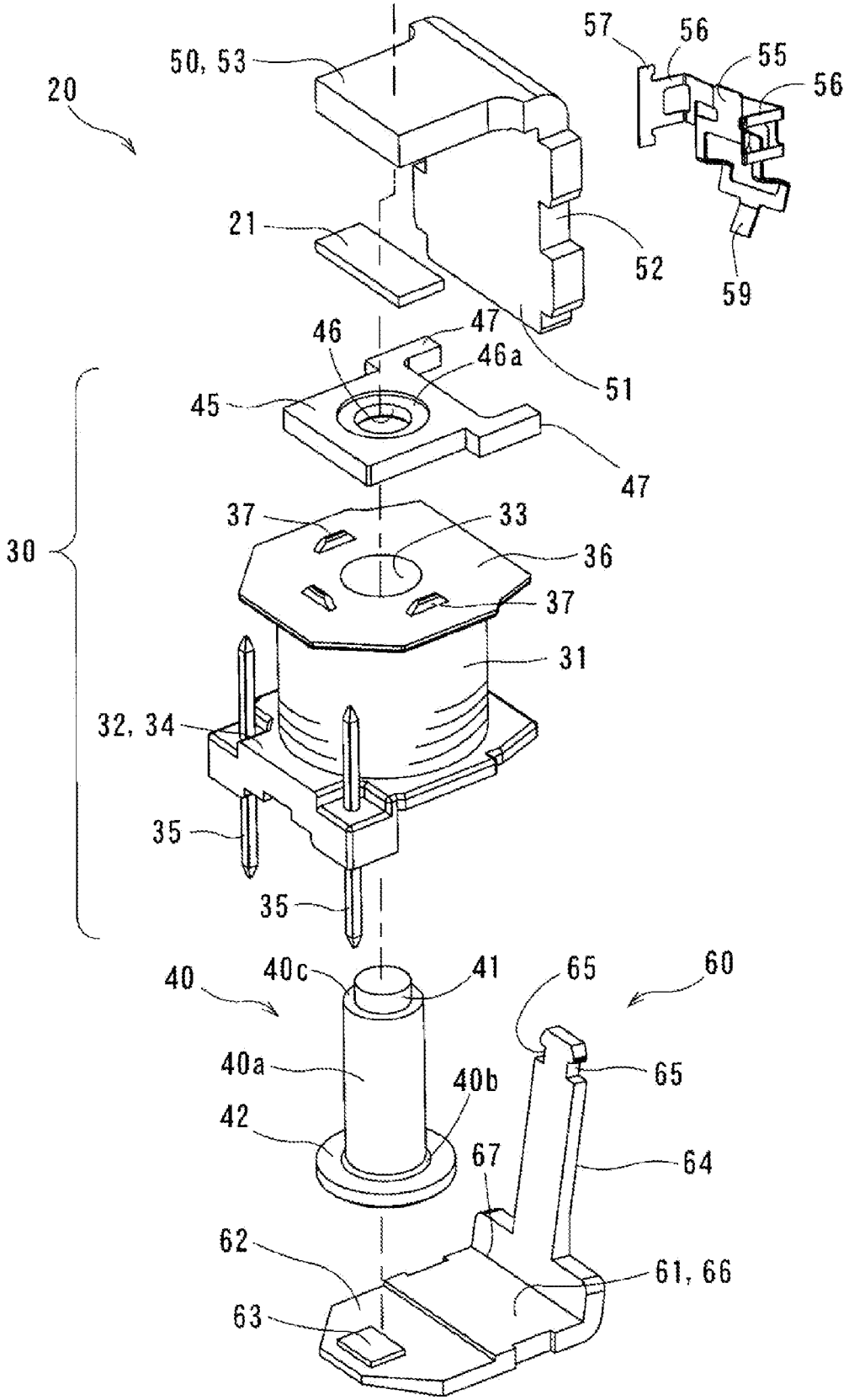
FIG. 5 is an exploded perspective view of the electromagnet device as illustrated in FIG. 4A, which is obliquely viewed from the top.

As illustrated in FIGS. 4A, 4B, and 5, the electromagnet device 20 includes an electromagnet block 30 in which an iron core 40 having an almost T-shaped cross section passes through a central hole 33 of a spool 32 around which a coil 31 is wound, and an auxiliary yoke 45 is caulking-fixed to an upper end portion 41 end (one end portion) of the iron core 40 which is passed through the central hole 33. The electromagnet device 20 further includes the yoke 50 having an L-shaped cross section which is assembled so that a plate-like permanent magnet 21 is interposed between the yoke 50 and an upper end face of the iron core 40, a support spring 55 attached to a rear surface of the yoke 50, and a movable iron piece 60 which is pivotably supported on a lower end face edge portion of the yoke 50 via the support spring 55. The lower end face edge portion of the yoke 50 serves as a fulcrum for pivoting the movable iron piece 60.

In the spool 32, extended wires of the coil 31 are connected and soldered to coil terminals 35, wherein the coil terminals 35 are press-fitted in corner portions of a lower guard portion 34. In the spool 32, an alignment protrusion 37 protrudes from an upper surface of an upper guard portion 36. The alignment protrusion 37 aligns a position of the auxiliary yoke 45.

The iron core 40 includes a cylindrical iron core body 40*a*, a cylindrical upper end portion (one end portion) 41 which is formed via a step portion 40*c* in an upper end of the iron core body 40*a* and has a smaller diameter than the iron core body 40*a*, and a disk-like magnetic pole portion 42 which is formed in a lower end of the iron core body 40*a* and has a larger diameter than the iron core body 40*a*. A curving portion 40*b* is formed along a circumferential direction in the boundary of the iron core body 40*a* and the magnetic pole portion 42.

The auxiliary yoke 45 has a caulking hole 46 in the center. In the auxiliary yoke 45, connection narrow-width portions (also referred to as narrow-width portion) 47 extend in parallel with each other from adjacent corner portions of the auxiliary yoke 45 respectively. The connection narrow-width portions 47 are magnetic resistance portions with a small cross-sectional area compared with a side surface of the auxiliary yoke 45. In an upper surface edge portion of the caulking hole 46, an annular step portion 46*a*, one step lower than the upper surface, is formed.

The plate-like permanent magnet 21 has a width dimension substantially the same as a width dimension of the auxiliary yoke 45.

The yoke 50 having an almost L-shaped cross section includes a vertical portion 51 provided with notch portions 52 which are formed at both sides of the vertical portion 51 respectively. The notch portions 52 function to elastically engage the support spring 55. The yoke 50 further includes a horizontal portion 53 which laterally extends from an upper end of the vertical portion 51.

Figure 6:
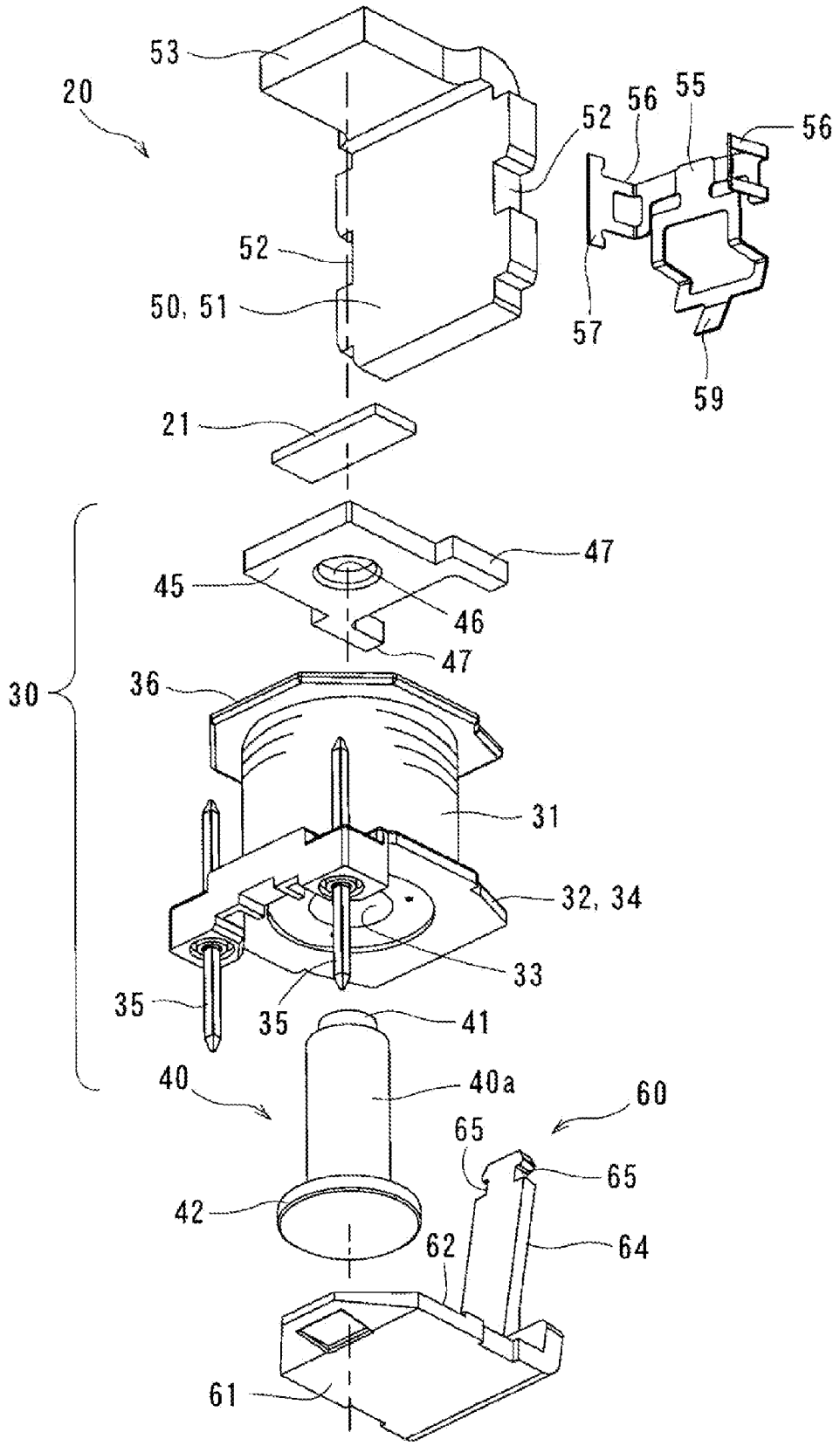
FIG. 6 is an exploded perspective view of the electromagnet device as illustrated in FIG. 4B, which is obliquely viewed from the bottom.

As illustrated in FIG. 5 and FIG. 6, in the support spring 55, a pair of elastic arm portions 56 extend in parallel with each other from both side edges of the support spring 55 respectively and an elastic support portion 59 extends from a lower edge portion of the support spring 55. An engaging pawl 57 is protrudes from a leading end of either of the elastic arm portions 56 and a latching pawl 58 stands up from a leading end of the other elastic arm portion 56.

The movable iron piece 60 includes an attracted surface 66 and a step portion 62. The attracted surface 66 has an approximately rectangular shape and is formed in a rear half portion on an upper surface of the horizontal portion 61. The step portion 62 is lower by one step than the attracted surface 66 and is formed in a front half portion. A contact protrusion 63 of a rectangular shape having a smaller area than the attracted surface 66 protrudes from the step portion 62 through a protruding process. The movable iron piece 60 has notch portions 65 for engaging the card 80 at both side edges of a leading end portion of the vertical portion 64 of the movable iron piece respectively. The boundary between the horizontal portion 61 and the vertical portion 64 serves as a pivoting shaft center 67. The pivoting shaft center 67 is latched to a lower end edge portion of the yoke 50.

As illustrated in FIG. 2, the contact mechanism 70 includes first and second fixed touch pieces 71, 72 arranged to face each other at a predetermined distance, and a movable touch piece 73 arranged between the first and second fixed touch pieces 71, 72. A movable contact 73*a* is provided in the movable touch piece 73. The first and the second touch pieces 71, 72 include a first and a second fixed contact respectively. The movable contact 73*a* is alternately attached to and detached from the first fixed contact 71*a* and the second fixed contact 72*a*. Two sets of latching pawls 74, 75 are provided in an upper end portion of the movable touch piece 73. The latching pawls 74, 75 vertically latch a remaining end edge portion 83 of the card 80.

As illustrated in FIGS. 2 and 3, in the card 80, the contact protrusion 81 protrudes from one end of edge portion 83, a pair of elastic arm portions 82 extend from both sides of the contact protrusion 81 respectively, and a pair of latching arm portions 84 extend from both ends of the remaining end of the edge portion 83 respectively.

The box-shaped cover 90 has a box shape which can fit in the base 10. The box-shaped cover 90 is provided with a position-regulating projecting portion 91 that bulges downward from a ceiling surface (refer to FIG. 8) thereof, and a degassing hole 92 provided in the bottom of the position-regulating projecting portion 91. The position-regulating projecting portion 91 prevents the card 80 aligned under the position-regulating projecting portion 91 from lifting. The box-shaped cover 90 has a marking recess 93 in an end portion of an upper surface thereof.

Figure 7A:
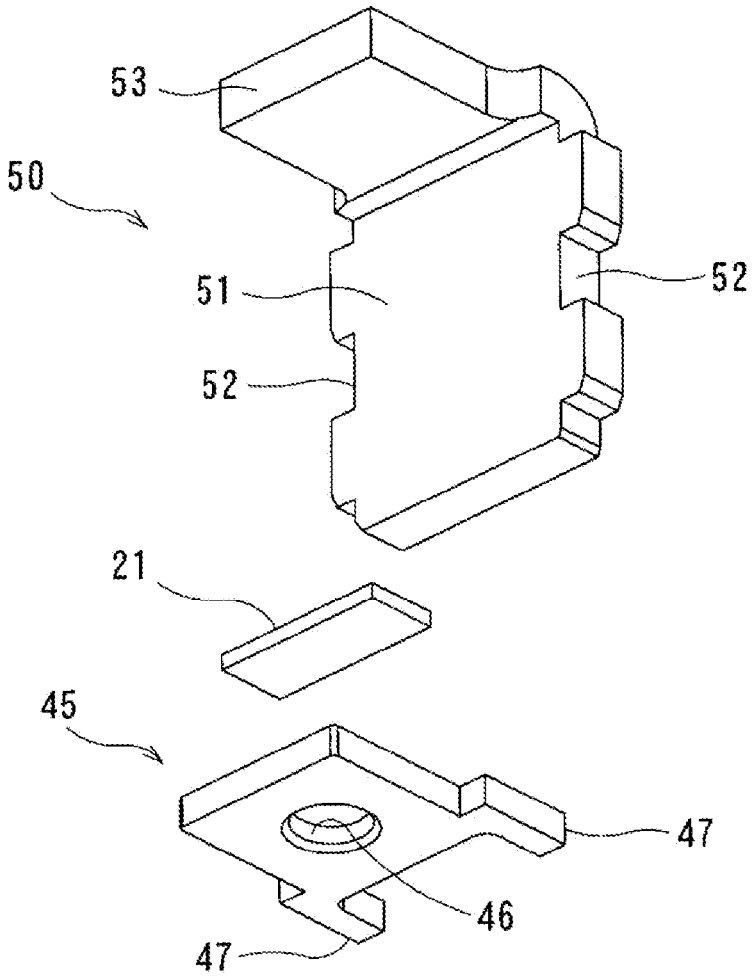
FIG. 7A is an exploded perspective view of a yoke, an auxiliary yoke, and a plate-like permanent magnet as illustrated in FIG. 6.
Figure 7B:
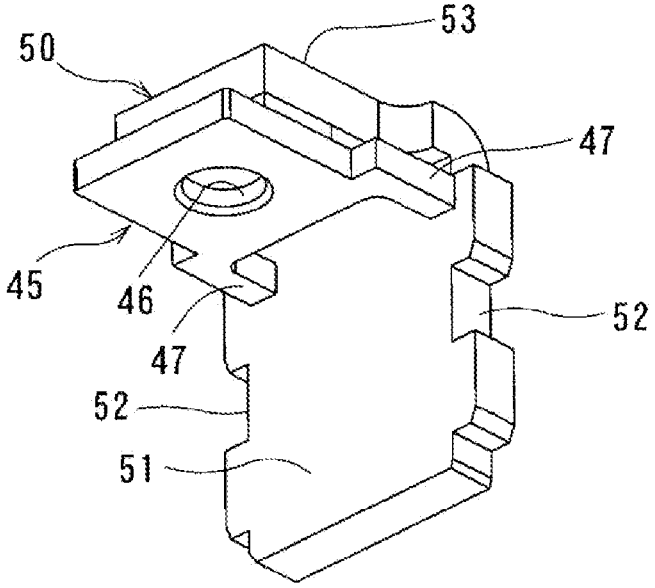
FIG. 7B is a perspective view showing a state in which the yoke, the auxiliary yoke, and the plate-like permanent magnet are assembled.

Accordingly, when assembling the electromagnetic relay, first, the permanent magnet 21 is integrally joined to the horizontal portion 53 of the yoke 50 (refer to FIGS. 7A and 7B). In this case, since the side surface of the horizontal portion 53 and the side surface of the permanent magnet 21 are flush with each other, alignment accuracy of the yoke 50 with respect to the permanent magnet 21 is increased. Next, the iron core 40 is inserted in the central hole 33 of the spool 32 around which the coil 31 is wound, and the upper end portion 41 which is passed through the central hole 33 is fixed to the auxiliary yoke 45 by spin caulking. In this way, the electromagnet block 30 is assembled. In this case, since the upper end portion 41 is subjected to spin caulking in a state in which the upper end portion 41 is fitted in the caulking hole 46, the iron core 40 can be fixed to the auxiliary yoke 45 with high alignment accuracy. Moreover, since the upper end portion 41 is fixed to the annular step portion 46*a* of the auxiliary yoke 45 by spin caulking, the caulked and crushed upper end portion 41 can be received within the annular step portion 46*a*. Accordingly, the permanent magnet 21 can be kept in area contact with the auxiliary yoke 45 in a state in which the crushed upper end portion 41 does not protrude from an upper surface of the auxiliary yoke 45. The term "spin caulking" means a method of pressing down the end portion of the upper end portion 41 while rotating a jig, thereby caulking the end portion into the caulking hole 46 of the auxiliary yoke 45.

The movable iron piece 60 is positioned in the lower end edge portion of the vertical portion 51 of the yoke 50. The engaging pawl 57 and the latching pawl 58 of the support spring 55 are engaged with and latched to the notch portions 52 of the yoke 50 respectively. In this way, the movable iron piece 60 is pivotably supported. Then, the connection narrow-width portion 47 of the electromagnet block 30 is joined to the vertical portion 51 of the yoke 50 by laser bonding. Thus, the electromagnet device 20 in which the plate-like permanent magnet 21 is interposed between the auxiliary yoke 45 and the horizontal portion 53 is completed. Since the connection narrow-width portions 47 that extend as two strips are laser-welded to the yoke 50, they can be easily welded in a simple manner, and the auxiliary yoke 45 and the yoke 50 can be stably fixed without wobbling. Then, both side edge portions of the yoke 50 are press-fitted in the fitting grooves 12 provided in the inside surfaces of the insulation wall 11 of the base 10. In the present embodiment, the connection narrow-width portions 47 are fixed to the yoke 50 by laser welding. However, the fixing method is not limited to laser wielding and any fixing method can be used which connects and fixes the connection narrow-width portions 47 to the yoke 50.

On the other hand, assembling is performed so that the second fixed touch piece 72, the movable touch piece 73, and the first fixed touch piece 71 of the contact mechanism 70 are press-fitted on the other side in the upper surface of the base 10 which is partitioned by the insulation wall 11. Subsequently, the contact protrusion 81 of the card 80 is brought into contact with an upper end portion of the movable iron piece 60, and the pair of elastic arm portions 82 are engaged with the pair of engaging notch portions 65 provided in the vertical portion 64 of the movable iron piece 60 respectively. The latching pawls 74 and 75 of the movable touch piece 73 are latched to the remaining end edge portion 83 of the card 80. Finally, the following process is performed and assembling work is completed. That is, the box-shaped cover 90 is fitted into the base 10, and sealing is performed by injecting a sealing material (not illustrated) into the bottom of the base 10. After that, inner gas is degassed through the degassing hole 92 of the box-shaped cover 90, and then the degassing hole 92 is subjected to heat caulking.

Figure 8A:
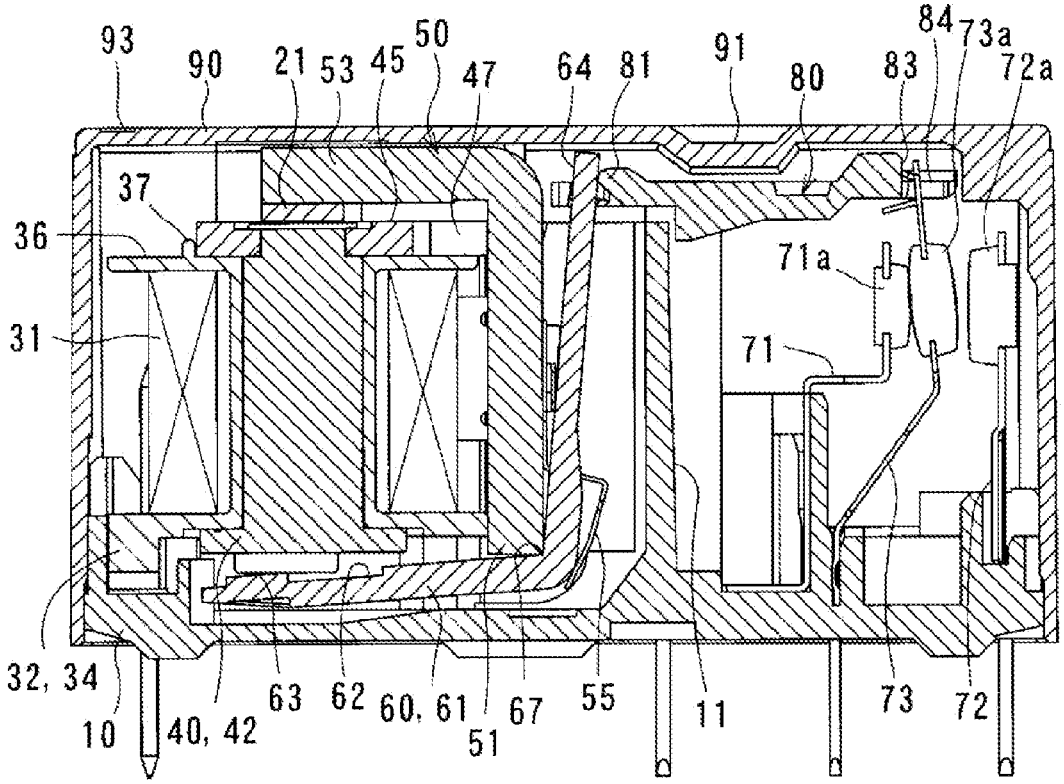
FIGS. 8A and 8B are cross-sectional views showing states before and after an operation of the electromagnetic relay illustrated in FIG. 1.
Figure 9A:
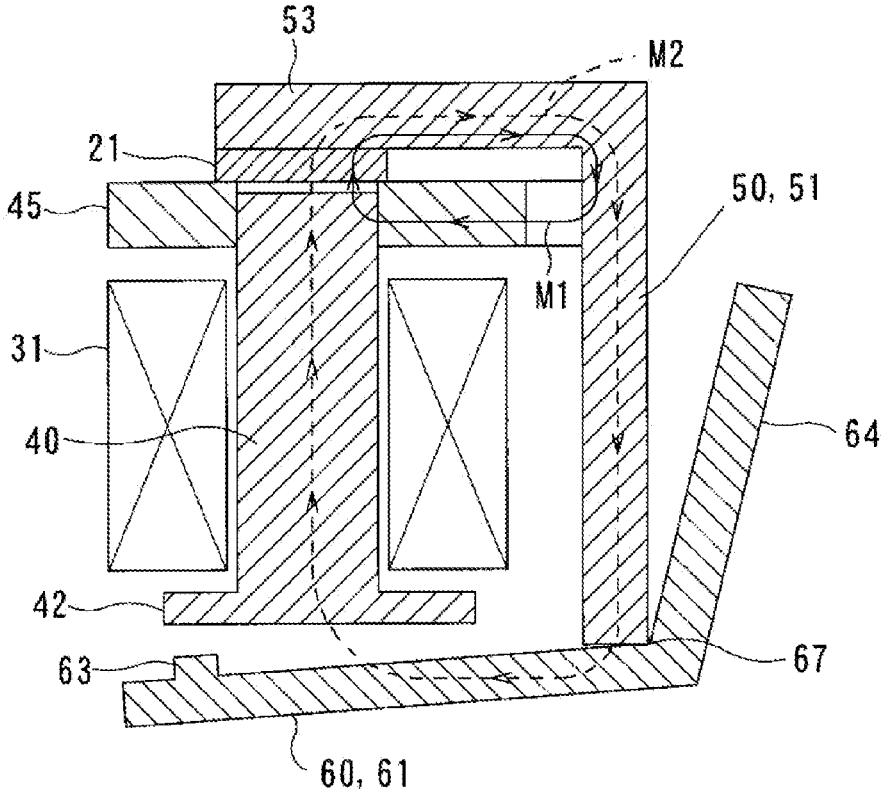
FIGS. 9A and 9B are schematic cross-sectional views for describing an operation process of the electromagnet device according to the invention.
Figure 9B:
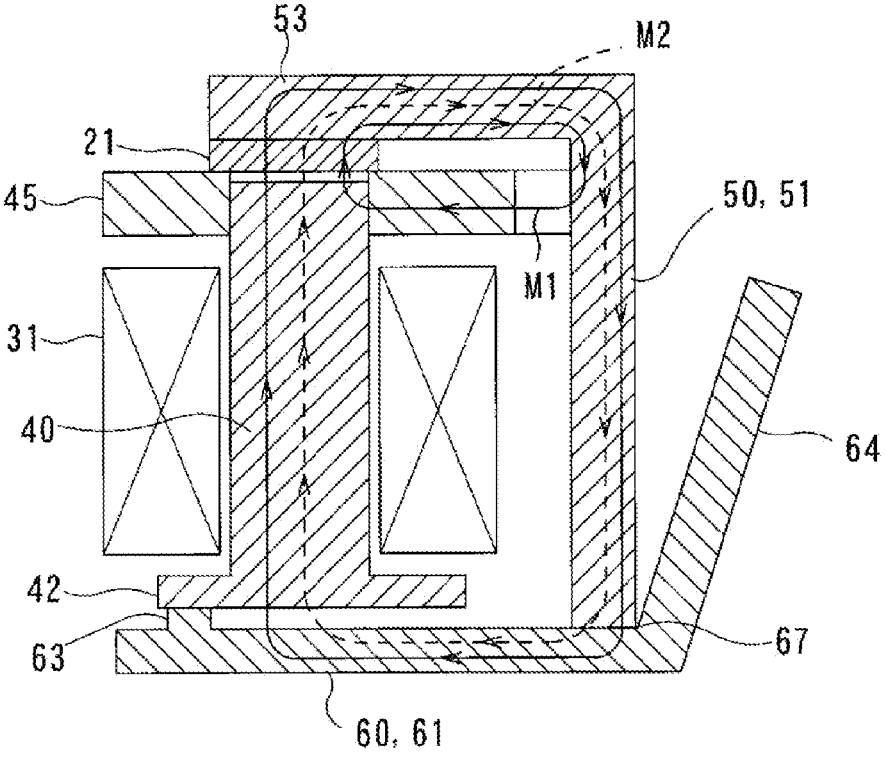

Next, an operation of the magnetic relay having the above-described structure will be described. As illustrated in FIG. 8A, when a voltage is not applied to the coil 31, while the contact protrusion 63 of the movable iron piece 60 is separated from the magnetic pole portion 42 of the iron core 40, the movable contact 73*a* is in contact with the first fixed contact 71*a*. In addition, the permanent magnet 21 is located on an extended line of the axial center of the iron core 40 and is interposed between the auxiliary yoke 45 and the yoke 50. As a result, in regard to the magnetic flux of the permanent magnet 21, as illustrated in FIG. 9A, the magnetic flux from out of the permanent magnet 21 flows through a magnetic circuit (an auxiliary magnetic circuit) M1 which is constructed of the auxiliary yoke 45, and leakage flux from out of the permanent magnet 21 forms a magnetic circuit (a main magnetic circuit) M2 via the yoke 50. The movable iron piece 60 is maintained by balance between a spring force of the movable touch piece 73 and the magnetism generated by the magnetic flux which flows through the magnetic circuit M1 and the magnetic flux that flows through the magnetic circuit M2. Although the magnetic circuit M1 is magnetically saturated, since the yoke 50 and the auxiliary yoke 45 are connected to each other via the connection narrow-width portions 47 having a cross section smaller than that of a contacted surface of the yoke 50, the magnetically saturated state more easily forms.

When the voltage is applied so that magnetic flux of the same direction as the magnetic flux of the permanent magnet 21 is generated in the coil 31, the magnetic flux generated by the voltage applied to the coil 31 flows to the magnetic circuit M2 (refer to FIG. 9B), and an attraction force which attracts the movable iron piece 60 increases. For this reason, the movable iron piece 60 pivots on the pivoting shaft center 67, resisting against the spring force of the movable touch piece 73. Thus the movable iron piece 60 is attracted to the magnetic pole portion 42 of the iron core 40, and the contact protrusion 63 is attached to the magnetic pole portion 42.

Figure 8B:
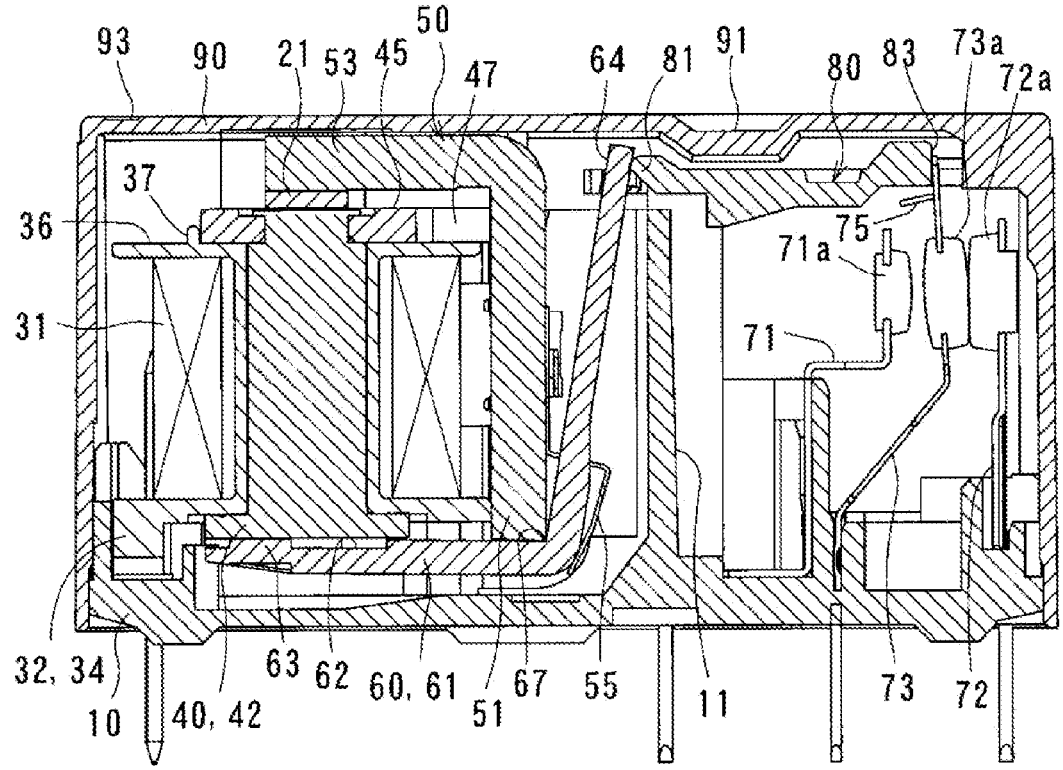

When the contact protrusion 63 is attracted to the magnetic pole portion 42, the vertical portion 64 of the movable iron piece 60 presses the movable touch piece 73 via the card 80, and the movable contact 73*a* separates from the first fixed contact 71*a*, and comes into contact with the second fixed contact 72*a* (FIG. 8B).

Figure 10A:
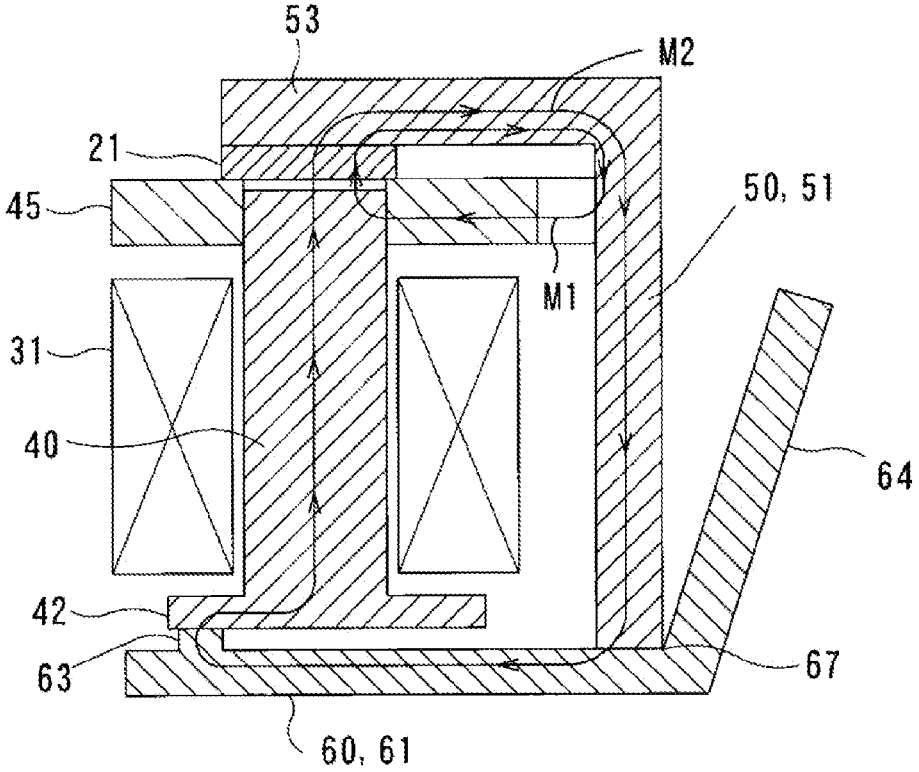
FIGS. 10A and 10B are schematic cross-sectional views for describing an operation process of the electromagnet device which is subsequent to the operation process illustrated in FIGS. 9A and 9B.
Figure 10B:
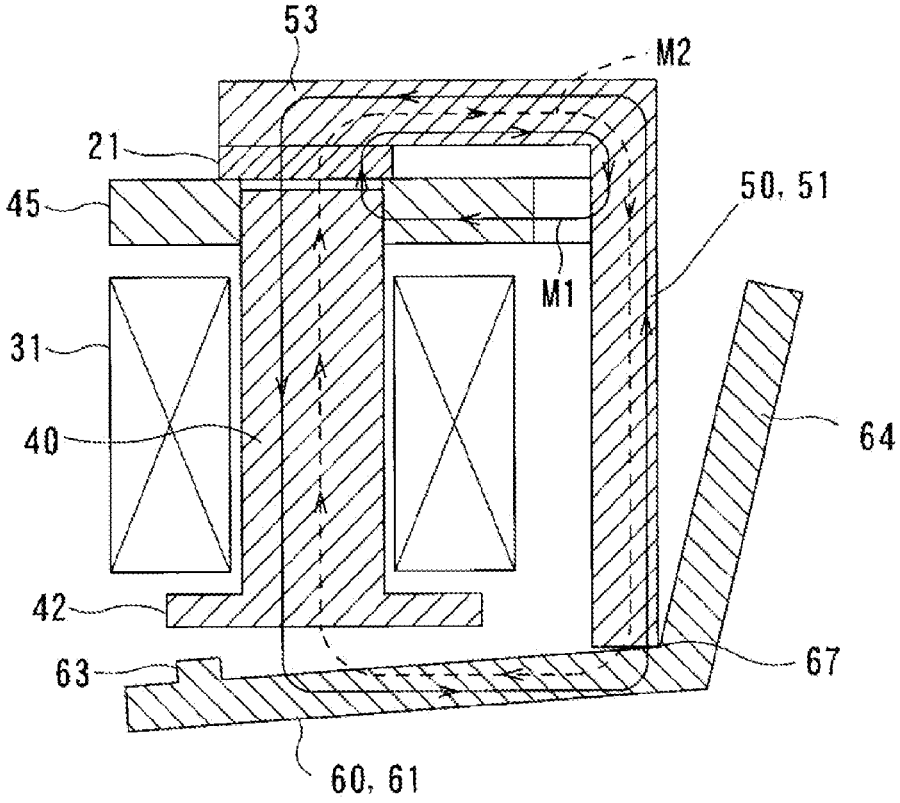

Subsequently, even though the application of the voltage to the coil 31 is stopped, as illustrated in FIG. 10A, a combined magnetic force of the magnetic flux which flows to the magnetic circuit M1 which includes the auxiliary yoke 45 from the permanent magnet 21, and the magnetic flux which flows to the magnetic circuit M2 which includes the yoke 50, the movable iron piece 60, and the iron core 40 is larger than the spring force of the movable touch piece 73. For this reason, the movable iron piece 60 maintains this current state, without pivoting.

When a return voltage of a direction reversed to the previously described application voltage is applied to the coil 31 (refer to FIG. 10B) so that the magnetism of the permanent magnet 21 acting on the movable iron piece 60 will be canceled, the movable contact 73*a* separates from the second fixed contact 72*a*, comes into contact with the first fixed contact 71*a*, and returns to the original state.

Even though the return voltage is applied in the present embodiment, since the magnetic circuit M1 is in a magnetically saturated state, the magnetic flux does not flow through the magnetic circuit M1. Whole magnetic flux of the coil is generated by the applied return voltage and flows to the magnetic circuit M2 which includes the yoke, the movable iron piece, and the iron core, and a return operation is carried out. It results in a latching type electromagnetic relay having high magnetic efficiency and consuming less power.

Figure 11:
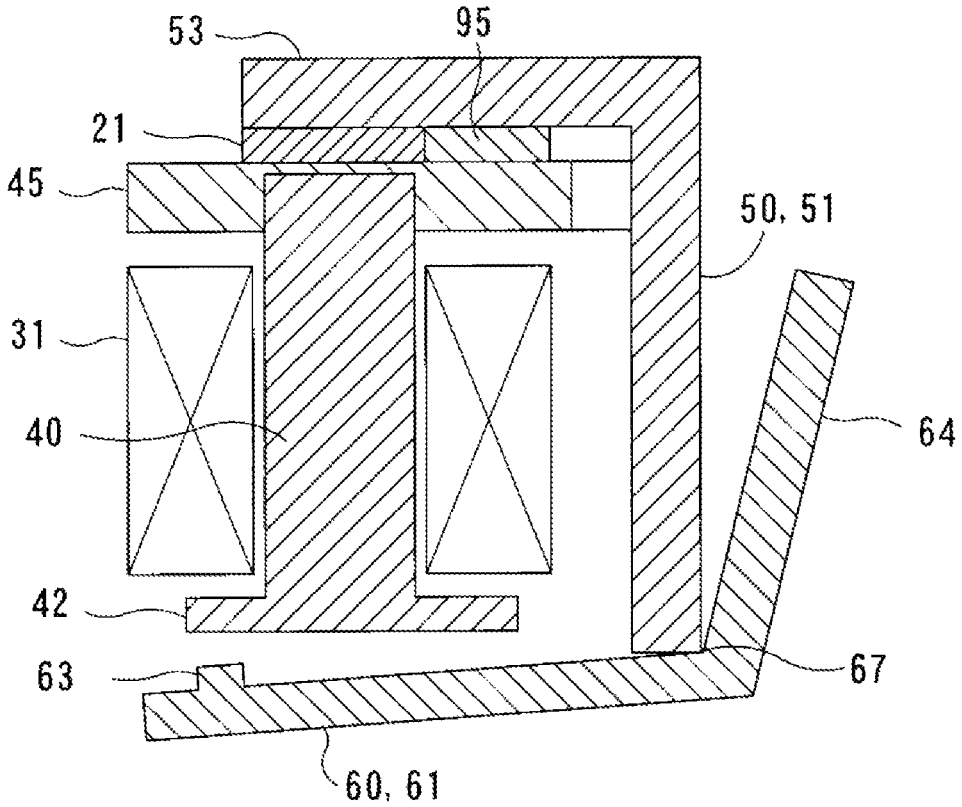
FIG. 11 is a schematic cross-sectional view showing a state in which an auxiliary yoke and a yoke are connected to each other by an adhesive.

The present invention is not limited to the above-described embodiment, but various modifications thereof are possible. In the above embodiment, at the time of assembling the electromagnet device 20, the connection narrow-width portions 47 are fixed to the yoke 50 by laser welding. However, the assembling method is not limited to laser wielding. For example, as illustrated in FIG. 11, in regard to the auxiliary yoke 45 and the yoke 50, the auxiliary yoke 45 and the yoke 50 may be joined to each other by applying an epoxy-based adhesive 95 to an inside surface of the plate-like permanent magnet 21. Since the auxiliary yoke 45 and the yoke 50 can be connected to each other only by a simple measure of applying an adhesive 95, assembling performance of the electromagnet device 20 improves. In addition, the method of applying the adhesive 95 and the method of laser-welding the connection narrow-width portions 47 to the yoke 50 both may be simultaneously employed.

In this embodiment, the electromagnet block 30 is assembled after the permanent magnet 21 is integrally joined to the horizontal portion 53 of the yoke 50. Alternatively, for example, the permanent magnet 21 may be integrally joined to an outer surface of the auxiliary yoke 45 after the electromagnet block 30 is assembled. With this method, alignment accuracy of the permanent magnet 21 with respect to the iron core 40 is improved.

It is needless to say that the electromagnet device according to the present invention is applied not only to an electromagnetic relay but also to other electronic equipment.

There has thus been shown and described an electromagnetic device and an electromagnetic relay which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment

What is claimed is:

1. An electromagnet device comprising:

an electromagnet block comprising an iron core being wound by a coil and an auxiliary yoke fixed to one end portion of the iron core;

a yoke connected to the one end portion of the iron core via a permanent magnet;

a movable iron piece having a pivoting shaft center, the movable iron piece being pivotally disposed at an end face edge portion of the yoke with the pivoting shaft center supported by and disposed in pivotal contact with the end face edge portion of the yoke, the movable iron piece being adapted to pivot on a basis of magnetization and demagnetization of the electromagnet block; and a connection portion disposed so as to connect the yoke with the auxiliary yoke;

wherein the permanent magnet located on an extension line of an axial center of the iron core and interposed between the auxiliary yoke and the yoke.

2. The electromagnet device according to claim 1, wherein the auxiliary yoke further comprises a caulking hole having an annular step portion on an upper surface of the caulking hole, and the one end portion of the iron core is fitted into the caulking hole.

3. The electromagnet device according to claim 2, wherein the one end portion of the iron core is fitted into the caulking hole by spin caulking.

4. An electromagnetic relay comprising the electromagnet device according to claim 3.

5. An electromagnetic relay comprising the electromagnet device according to claim 2.

6. The electromagnet device according to claim 1, wherein the connection portion comprises a plurality of narrow-width portions, the narrow-width portions extends from corner portions of the auxiliary yoke which are adjacent to each other.

7. An electromagnetic relay comprising the electromagnet device according to claim 6.

8. An electromagnetic relay comprising the electromagnet device according to claim 1.

* * * * *